US007125284B2

(12) United States Patent
Ripper et al.

(10) Patent No.: US 7,125,284 B2
(45) Date of Patent: Oct. 24, 2006

(54) MINIATURIZED ELECTRICAL CONNECTOR WITH IMPROVED CRIMPABILITY

(75) Inventors: Hartmut Ripper, Darmstadt (DE); Gabriel Hotea, Offenbach (DE); Volker Seipel, Bensheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 11/339,182

(22) Filed: Jan. 25, 2006

(65) Prior Publication Data

US 2006/0183366 A1 Aug. 17, 2006

(30) Foreign Application Priority Data

Feb. 16, 2005 (DE) ..... 10 2005 007 066

(51) Int. Cl.
*H01R 13/40* (2006.01)

(52) U.S. Cl. ..... 439/596; 439/620.05

(58) Field of Classification Search ..... 439/188, 439/467–468, 596, 694, 881, 902, 620
See application file for complete search history.

(56) References Cited

U.S. PATENT DOCUMENTS 4,666,231 A * 5/1987 Sheesley et al. ..... 439/581
4,944,693 A * 7/1990 Puerner ..... 439/358
5,122,081 A 6/1992 Bogiel et al.
5,288,242 A * 2/1994 Muzslay ..... 439/349
6,234,843 B1 * 5/2001 Pavlovic ..... 439/620
6,244,901 B1 * 6/2001 Fujii et al. ..... 439/596
6,761,589 B1 * 7/2004 Venditti et al. ..... 439/596
6,837,745 B1 * 1/2005 Takada et al. ..... 439/595

FOREIGN PATENT DOCUMENTS

EP 0600418 B1 3/1998
EP 1006621 B1 1/2005
WO WO 95/17775 6/1995

* cited by examiner

*Primary Examiner*—Tho D. Ta
(74) *Attorney, Agent, or Firm*—Barley Snyder LLC

(57) ABSTRACT

The invention relates to an electrical connector for contacting at least one electrical lead and for connection with a complementary connector, to an electrical plug-in connection for connecting at least one electrical lead to an electronic component and to an assembly method for assembling such an electrical connector. In order to provide an electrical connector of the above type and an associated assembly method which ensures simple, inexpensive producibility on the one hand and robust and reliable contactability on the other hand, and which additionally enables the greatest possible miniaturization, the connector (100) comprises a housing (116), in which the contact element (120) is at least partially accommodated and on which there is arranged a terminal cover (118) for covering the terminal area (124), which cover comprises a first lid part (126) and a second lid part (128), which are so constructed that they may both be moved to expose the terminal area (124) during fitting of the electrical lead (104).

40 Claims, 10 Drawing Sheets

MINIATURIZED ELECTRICAL CONNECTOR WITH IMPROVED CRIMPABILITY

FIELD OF THE INVENTION

The present invention relates to an electrical connector for connecting at least one electrical lead to a complementary connector and an electronic component and to an assembly method for assembling such an electrical connector. More particularly, the present invention relates to electrical connectors which may be used in contacting igniters for an airbag of a motor vehicle.

BACKGROUND

Known airbag arrangements are used as automotive safety components in virtually every vehicle. An airbag arrangement comprises an inflatable restraining device, which is accommodated in the steering wheel, the instrument panel or the side door and is inflated by means of a gas generator in the event of sufficiently forceful deceleration. The gas generator is conventionally actuated by means of an explosive ignition device, which is also known as an igniter or squib and contains a gunpowder-like material. The igniter is ignited electronically in response to an electrical signal, which is emitted via electrical leads by an acceleration sensor or the like in the vehicle. Contact is established between these electrical leads and the igniter via a dedicated connector, also known as a "squib connector". A known igniter socket arrangement, as known for example from EP 0 600 418 B1, comprises two connector pins, which are connected to the two electrical leads via contact elements of an electrical connector.

In the motor vehicles, especially at a safety-relevant location, such an electrical plug-in connection is generally produced to extremely high specifications for resistance to vibrations, temperature fluctuations or electromagnetic interference.

To fit the electrical connector on the electrical lead, it is conventional to connect a metallic contact element to the electrical lead and then fit it in a housing. As is known for example from EP 1 006 621 B1, the housing may comprise a hinged lid portion, which allows fitting of the contact elements. This solution has a disadvantage, however, that the crimping process, during which the contact elements are connected to the electrical lead, has to be performed before the contact element has been assembled in the housing.

The known solutions additionally exhibit a disadvantage that an additional tool is necessary in the case of bent contact elements to produce the angled contact.

It is therefore an object of the invention, among others, to provide a miniaturized electrical connector of the above type and an associated assembly method which ensures simple, inexpensive producibility on the one hand and robust and reliable contactability on the other hand.

SUMMARY

This and other objects are achieved by the invention which is based on the idea that the contact elements may be prefitted in the housing and connected to the electrical lead using the tools optimized for production of the electrical connection. The connector comprises a housing in which at least one contact element is at least partially accommodated and on which there is arranged a terminal cover for covering a terminal area of the contact element. The cover comprises a first lid part and a second lid part, which are so constructed that they may both be moved to expose the terminal area during fitting of the electrical lead.

BRIEF DESCRIPTION OF THE DRAWINGS

The present invention will be explained in more detail below with reference to the embodiments illustrated in the accompanying drawings. Similar or corresponding details are provided with the same reference numerals in the Figures, in which:

FIG. 19 is a perspective view of the arrangement of FIG. 17 before the second lid part is pushed on;

DETAILED DESCRIPTION OF THE EMBODIMENTS

Figure 1A:
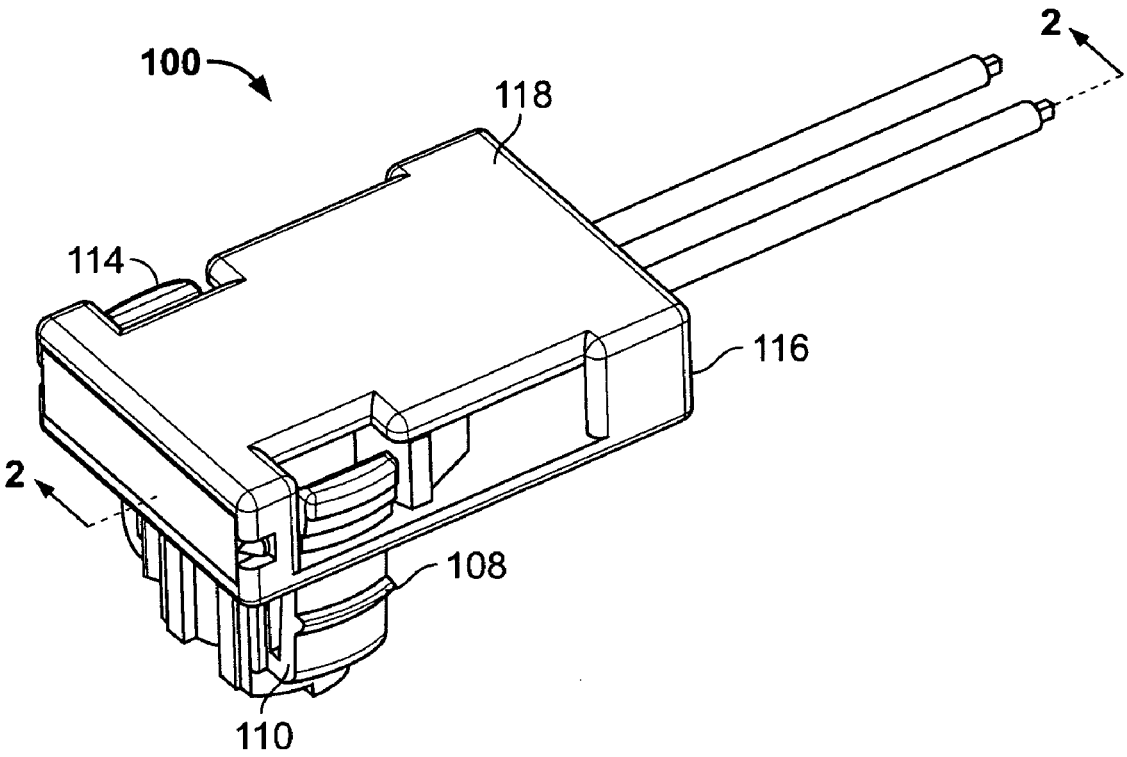
FIG. 1 is a perspective view of an electrical connection with a first connector according to the invention and a complementary connector.
Figure 1B:
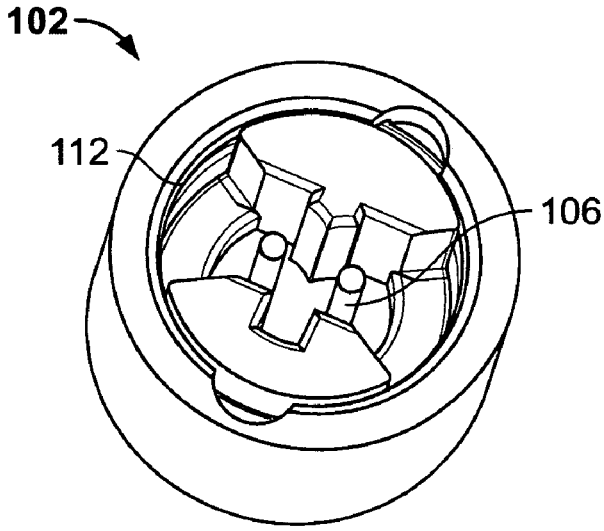

FIG. 1 shows an electrical connector 100 according to the invention, in this case an igniter connector, for mating with a complementary connector 102, in this case a connector base in the form of a pin connector for the igniter of a gas generator, which is used in a motor vehicle to operate an airbag. Through the connector 100, the two electrical leads 104 may be connected to the complementary contact elements 106, in the form of plug pins, of the complementary connector 102. Two latching projections 108, which are in each case molded on to a latching arm 110, cooperate with a latching recess 112 provided in the complementary connector 102 in such a way that the inserted electrical connector 100 can no longer become unintentionally detached. An actuating projection 114 is molded on each latching arm 110, which projection allows the user to release the plug-in connection between the electrical connector 100 and the complementary connector 102.

According to the invention, the housing 116, made for example of plastic, of the electrical connector 100 comprises a terminal cover 118, which covers the terminal area 124, in which the electrical leads 104 are connected to contact elements 120.

Figure 2:
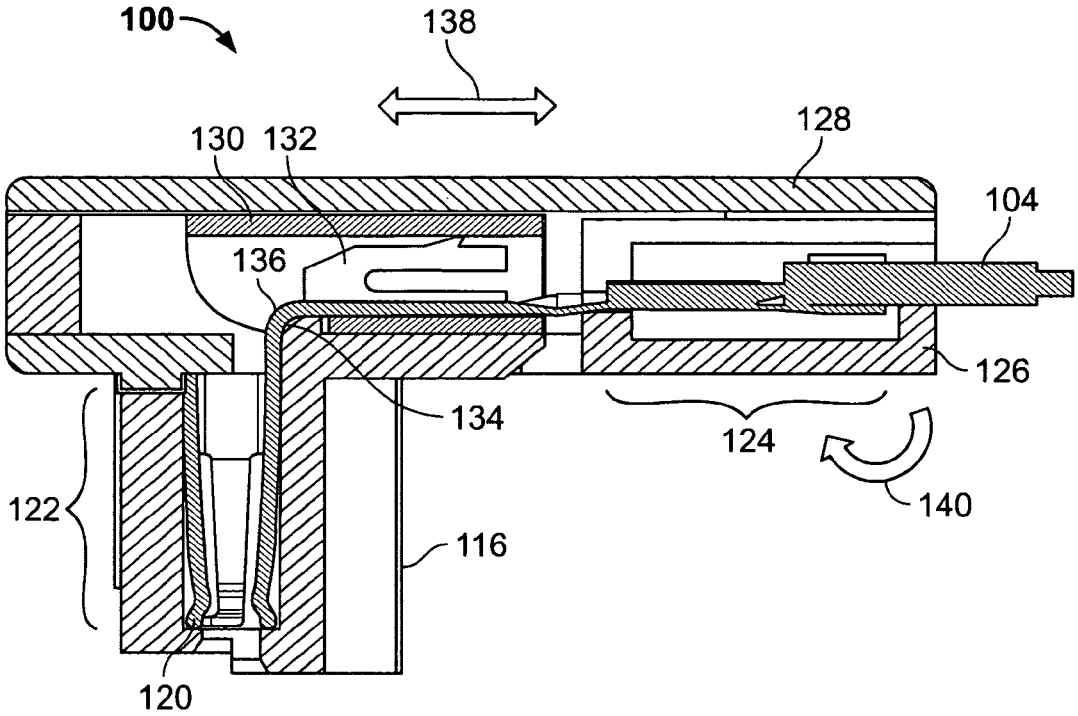
FIG. 2 is a sectional view of the connector taken along section line 2—2 of FIG. 1.

The section illustrated in FIG. 2 along section line 2—2 clarifies the structure according to the invention of the connector 100. The contact areas 122 of two metallic contact elements 120 ensure electrical contacting of the complementary contact elements 106 of the complementary connector 102. Connection to the electrical lead 104 is produced in the terminal area 124 of the contact element 120 via a crimp connection.

According to the invention, the terminal cover 118, which protects the terminal area 124 when finally assembled, comprises a first lid part 126 and a second lid part 128. As will become clear with reference to the subsequent figures, the first lid part 126 and the second lid part 128 may be moved for fitting of the electrical lead 104 in order to fully expose the terminal area 124 of the contact element 120 for the crimping process of the contact element 120 held in the housing 116.

In order to attenuate radio frequency interference, a ferrite core 130 is arranged on the contact element 120 in an area between the contact area 122 and the terminal area 124. To ensure that the ferrite core 130 is secured in its position on the contact element 120, two fixing elements 132 are provided on the contact element 120. In the embodiment shown, the fixing element 132 is formed by a resilient arm, which fixes the contact element 120 in an opening of the ferrite core 130 by clamping.

Furthermore, the housing 116 comprises a rounded bending edge 134, around which the contact element 120 may be bent in a bending zone 136 located between the contact area 122 and the terminal area 124. The longitudinal axis of the contact area 122 then forms an angle of 90° with the longitudinal axis of the terminal area 124. It goes without saying that other angles may also be established, depending on space requirements.

The electrical leads 104 may take the form, for example, of so-called FLR cables with a cross-sectional area of 0.5 $mm^2$.

Figure 3:
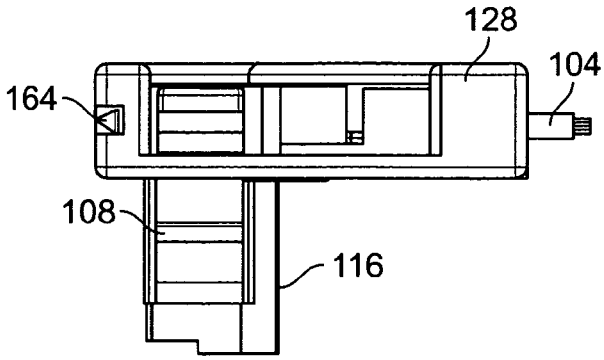
FIG. 3 is a side view of the electrical connector of FIG. 1.
Figure 4:
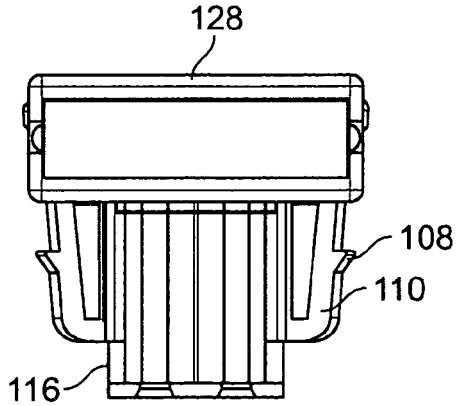
FIG. 4 is a side view of the connector of FIG. 1 rotated by 90°.

FIGS. 3 and 4 show side views of the electrical connector 100 according to the invention in the fully assembled state. These views clearly show the space-saving construction of the electrical connector 100 and the considerable degree to which it has been miniaturized.

Figure 5:
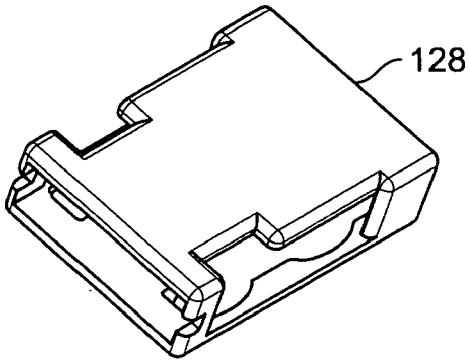
FIG. 5 is a perspective view of a second lid part taken from above.
Figure 6:
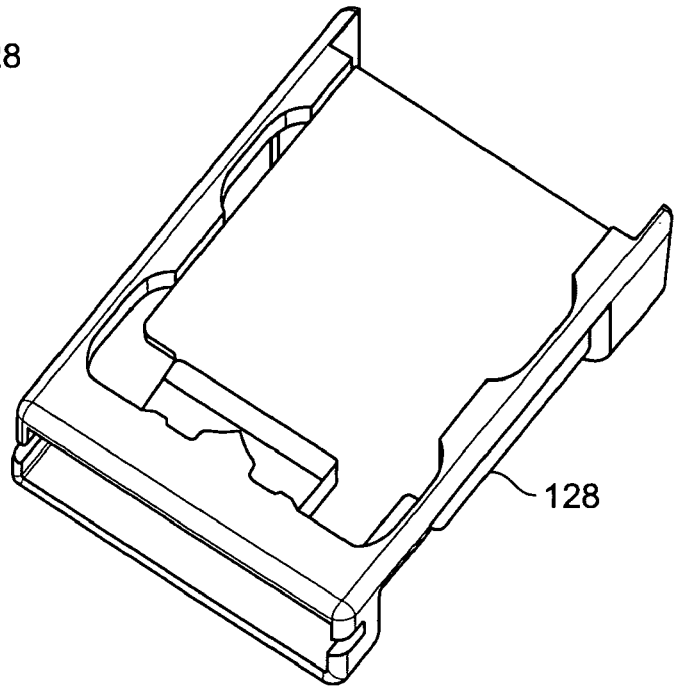
FIG. 6 is a perspective view of the lid part of FIG. 5 rotated by 180°.
Figure 13:
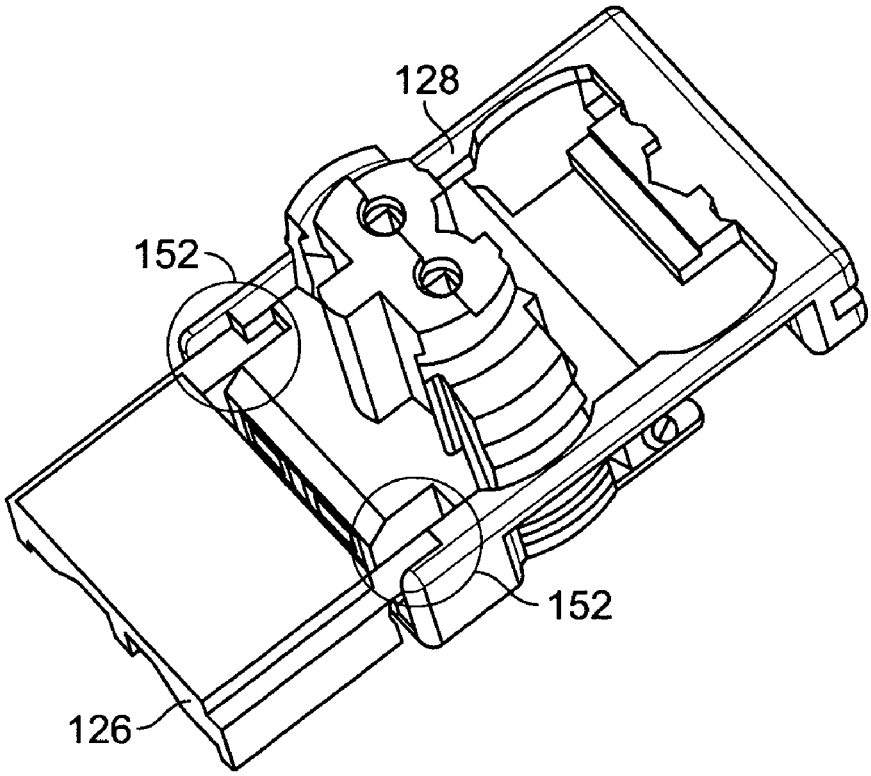
FIG. 13 is a perspective view of the arrangement of FIG. 12 rotated by 180°.

FIGS. 5 and 6 are perspective views, which have in each case been rotated by 180° relative to one another, of the second lid part 128. As will become clear with reference to the subsequent figures, this second lid part 128 may be displaced for the crimping process in a direction 138, to expose the terminal area 124 from above. The first lid part 126 is attached pivotally to the housing 116 via film hinges 152 as shown in FIG. 13, such that it may be pivoted in a direction 140 out of the terminal area.

Figure 7:
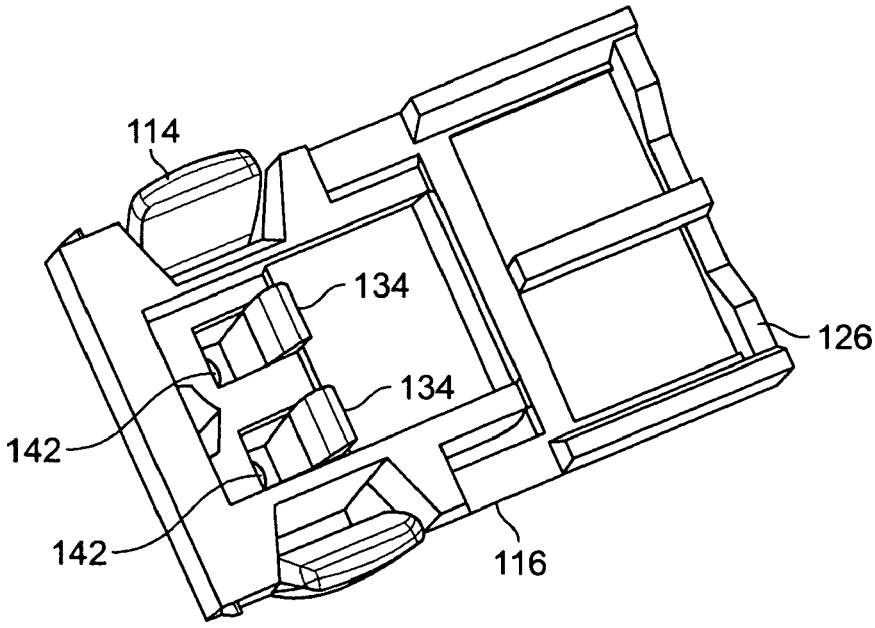
FIG. 7 is a perspective view of the housing with the first lid part taken from above.
Figure 8:
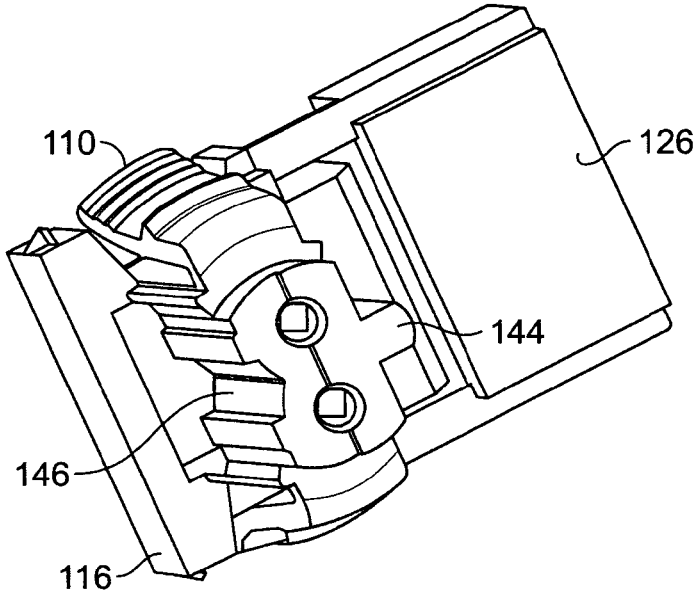
FIG. 8 is a perspective view of the housing of FIG. 7 rotated by 180°.

FIGS. 7 and 8 are perspective representations of the rest of the housing 116 with the first lid part 126. The representation of FIG. 7 also clearly shows the bending edges 134 required for bending the contact elements 120, said bending edges 134 being provided at the edges of contact receptacles 142. The view in FIG. 8 of the connector face additionally shows clearly the keying provided by a guide projection 144 and a guide receptacle 146, these preventing the connector 100 from being incorrectly inserted, and the latching arms 110 for fixing the connector 100 in the complementary connector 102. The contact spacing of the connector face may be about 3.1 mm for example.

Figure 9:
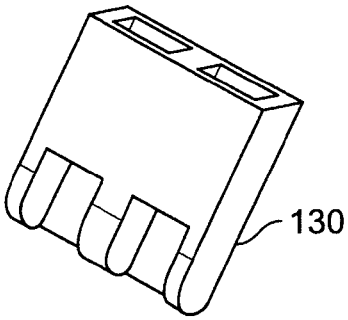
FIG. 9 is a perspective view of a two-path ferrite core.
Figure 10:
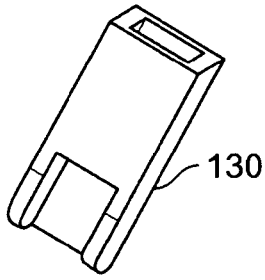
FIG. 10 is a perspective view of a ferrite core for an individual contact element.

FIGS. 9 and 10 show perspective views of two possible embodiments of the ferrite core 130. The ferrite core 130 may, as shown in FIG. 9, take the form of a two-path ferrite core, in which in each case two contact elements 120 are arranged. This embodiment has the advantage that the two contact elements 120 are already held for assembly by the ferrite core 130. However, this variant exhibits the disadvantage that the contact spacing of the two contact elements, as arranged in the ferrite core 130 of FIG. 9, does not correspond to the contact spacing of the contact elements on a punched strip. If, on the other hand, individual ferrite cores 130 are used, as shown in FIG. 10, this has the advantage that the ferrite cores 130 may be fitted on the contact elements 120 on the punched strip in a reel-to-reel process.

Figure 11:
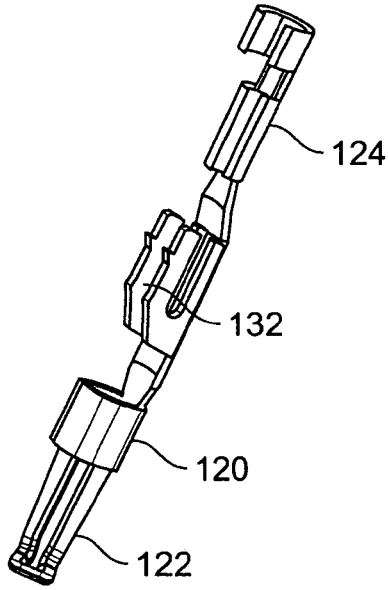
FIG. 11 is a perspective view of a contact element.

FIG. 11 is a perspective view of a contact element 120 prior to fitting of the ferrite core 130. As is clear from this illustration, the contact element 120 comprises a contact area 122, which in the case of an electrical connector takes the form of a socket contact, and a terminal area 124, which is designed to provide crimp contact with a lead. For this purpose, the terminal area 124 comprises a crimp zone for producing the actual electrical contact, and elements for strain relief.

Two fixing elements 132 are provided on the contact element 120 in the form of spring arms, which expand to fix the contact element 120 in place after insertion into the ferrite core 130.

Figure 12:
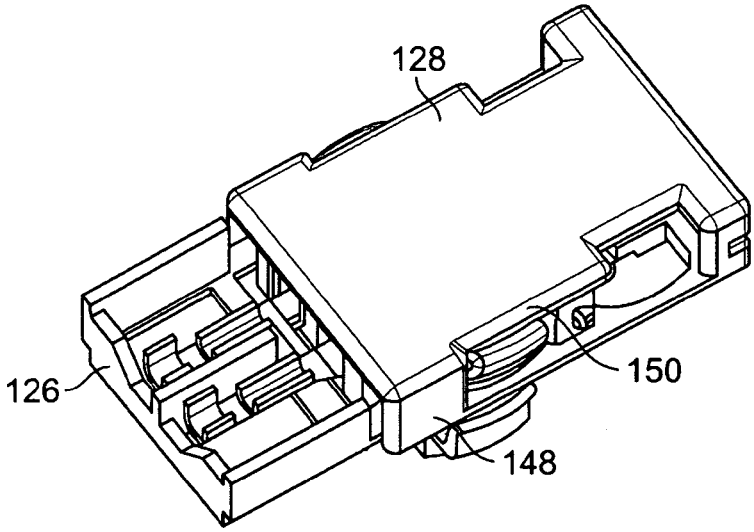
FIG. 12 is a perspective view of the housing with the contact elements fitted therein and the second lid part in the preliminary latched position.

FIGS. 12 and 13 show two perspective illustrations, in each case rotated by 180°, of the electrical connector 100 in a preliminary latched position, as may be provided for example for delivery to a wiring manufacturer. As is visible in FIG. 12, the pivotal first lid part 126 is substantially parallel to the terminal areas 124 of the contact elements 120, such that the crimp zones thereof are protected during transportation. Unintentional bending or deformation is not possible. The second lid part 128 is in a position in which the terminal areas 124 are exposed but the contact areas 122 of the contact elements 120 are concealed for protection. In this position, the latching arm 110 acts as latching means for the second lid part 128. In addition, the wall elements 148 and 150 on the second lid part 128 prevent damage to the latching arms 110. The film hinges 152 provide sufficient stiffness for the first lid part 126 for the position shown in FIG. 13 to be maintained.

Figure 14:
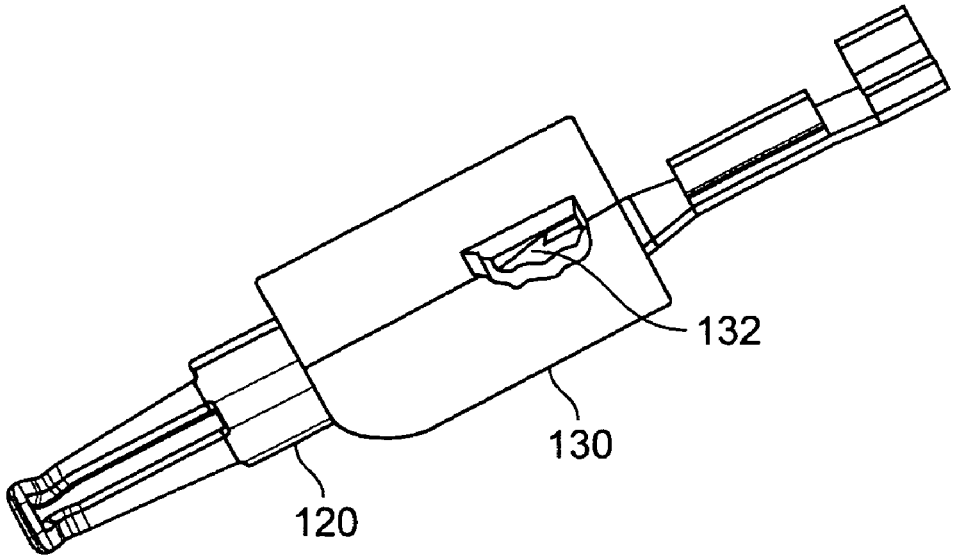
FIG. 14 is a cutaway perspective view of an individual contact element with the ferrite core of FIG. 10.
Figure 15:
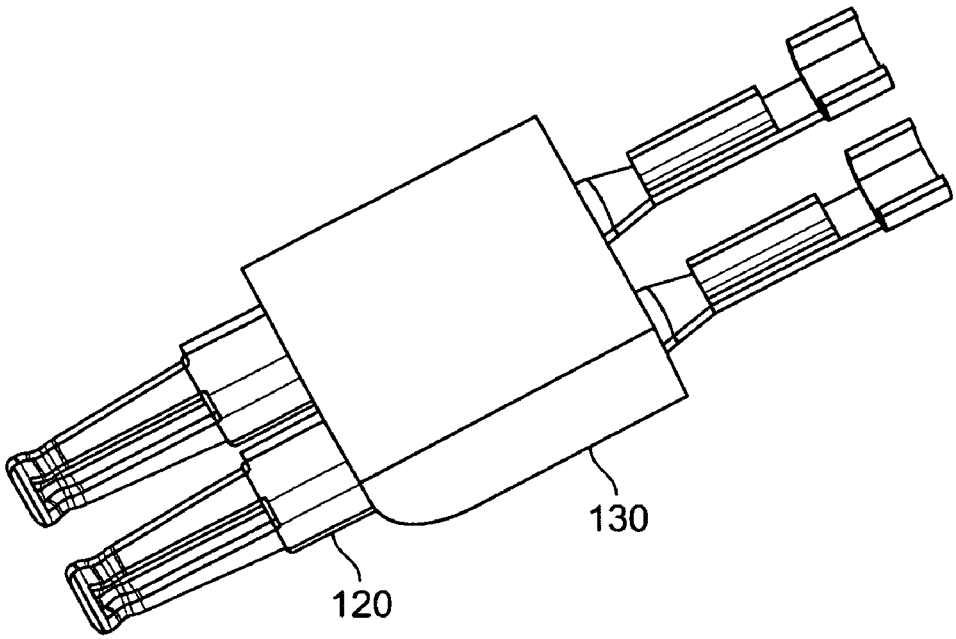
FIG. 15 is a perspective view of the two-path ferrite core of FIG. 9 with two contact elements fitted therein.

FIGS. 14 and 15 are perspective representations of the contact elements 120 each fitted in the ferrite core 130, the partially broken-away representation of FIG. 14 showing engagement of the fixing element 132 against the internal wall of the ferrite core 130 to fix the contact element 120 in the ferrite core 130. For the following illustrations, which are intended to shed more light on the processes involved in assembly and contacting of the electrical connector 100, the two-path ferrite core solution of FIG. 15 was selected in each case. It goes without saying, however, that a greater or lesser number of contact elements 120 may be accommodated in one ferrite core 130, depending on how many openings are provided.

Figure 16:
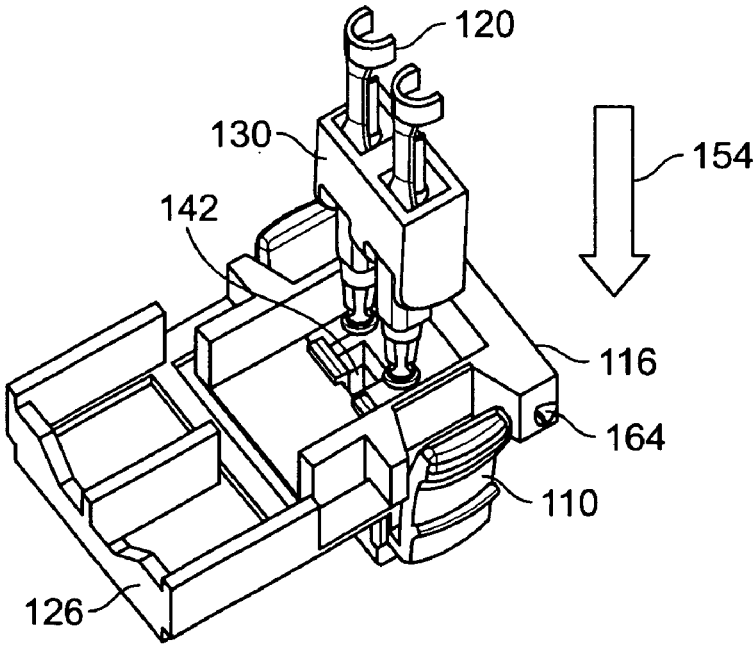
FIG. 16 is a perspective view of the contact elements and the ferrite core of FIG. 15 on installation in the housing.
Figure 17:
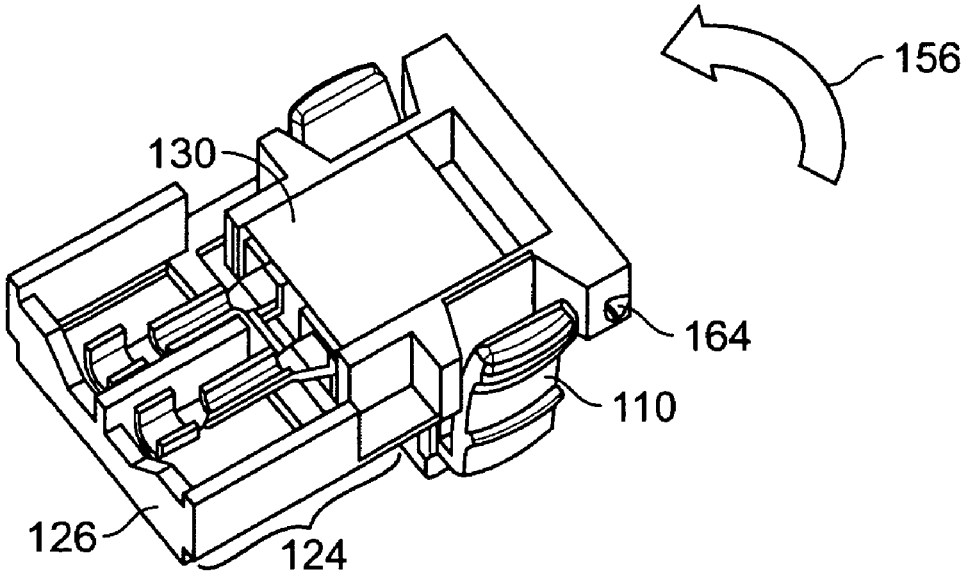
FIG. 17 is a perspective view of the arrangement of FIG. 16 after bending of the contact elements into their final position.
Figure 18:
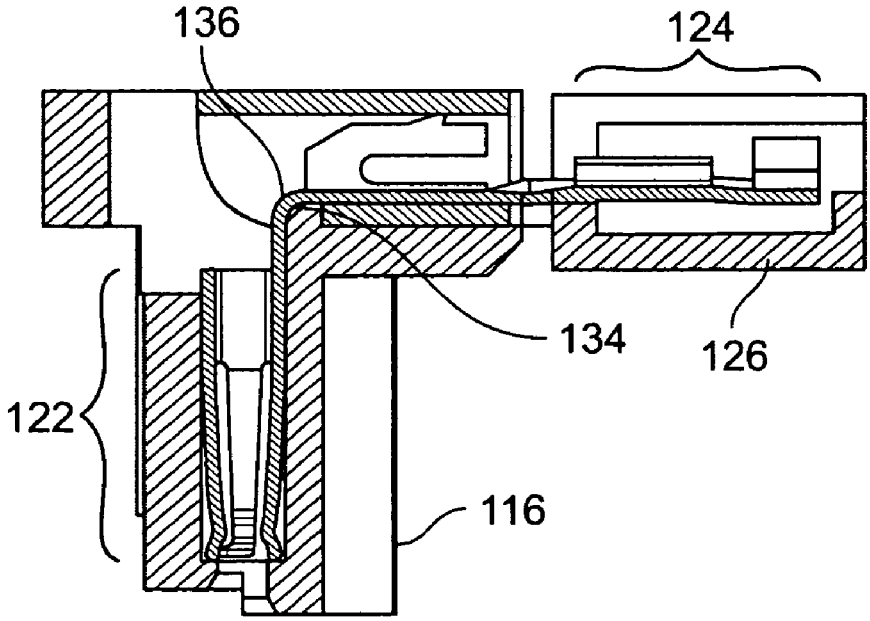
FIG. 18 is a longitudinal sectional view through the arrangement of FIG. 17 in the area of the contact elements.

FIGS. 16 to 18 are intended to explain fitting of the contact elements 120 in the housing 116. First of all, the contact elements 120 are fitted in a ferrite core 130. Then, as is symbolized by the arrow 154, they are introduced into corresponding contact receptacles 142 in the housing 116. The ferrite core 130 and the terminal areas 124 of the contact elements 120 are then bent round the bending edge 134 on the housing 116, shown in FIG. 18, in direction 156. The contact elements 120 thus have the necessary bent shape and are installed in optimum manner in the housing.

Figure 19:
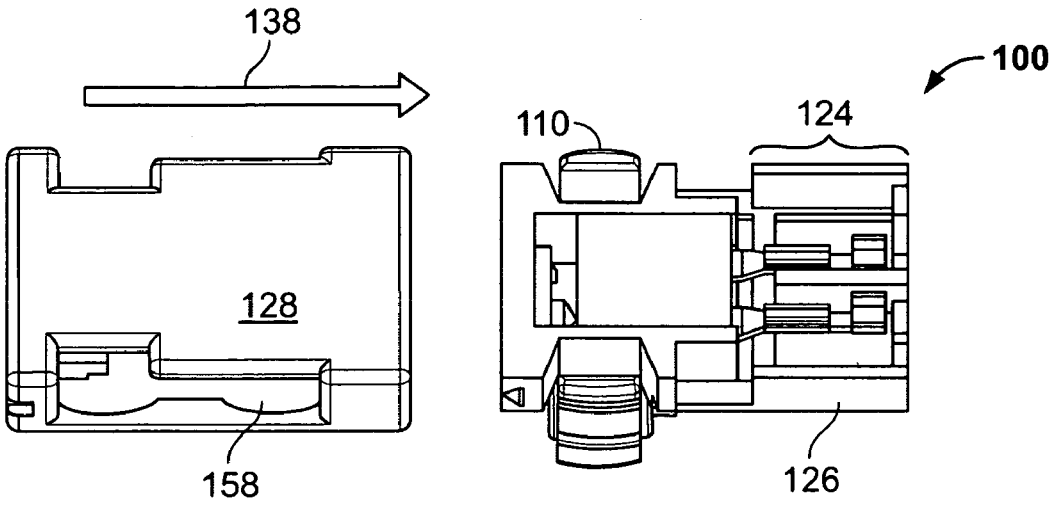

As shown in FIG. 19, the second lid part 128 is then pushed on in direction 138. Once the latching arms 110 have been latched together with the first latching receptacles 158, the electrical connector 100 finds itself in the preliminary latched position shown in FIG. 12. The electrical connector 100 may be delivered in this state to a wiring manufacturer.

Figure 20:
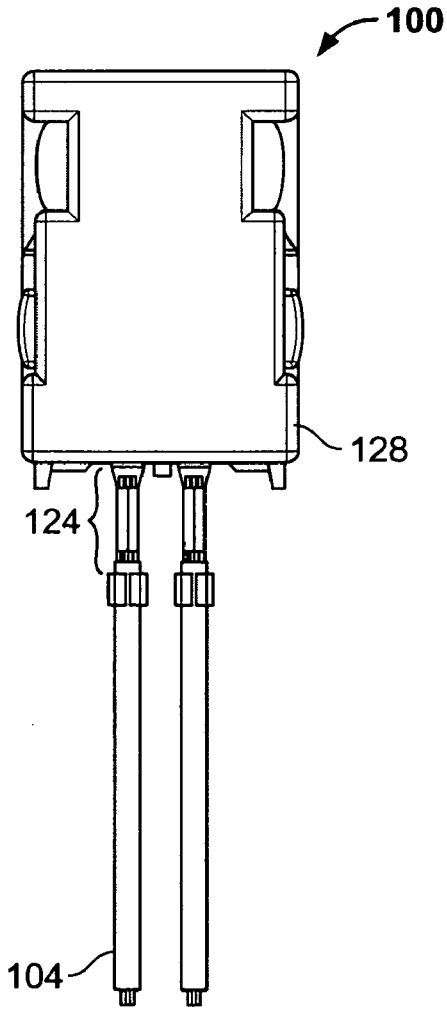
FIG. 20 is a top view of the arrangement of FIG. 12 with exposed terminal areas.
Figure 21:
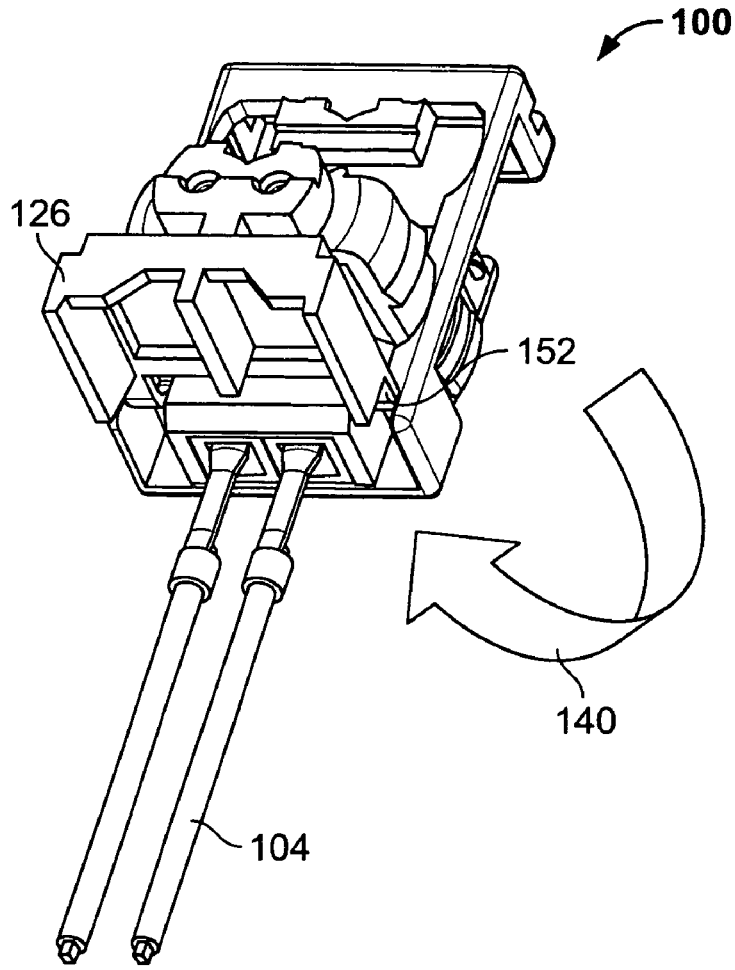
FIG. 21 is a perspective view of the arrangement of FIG. 20, rotated by 180°.
Figure 22:
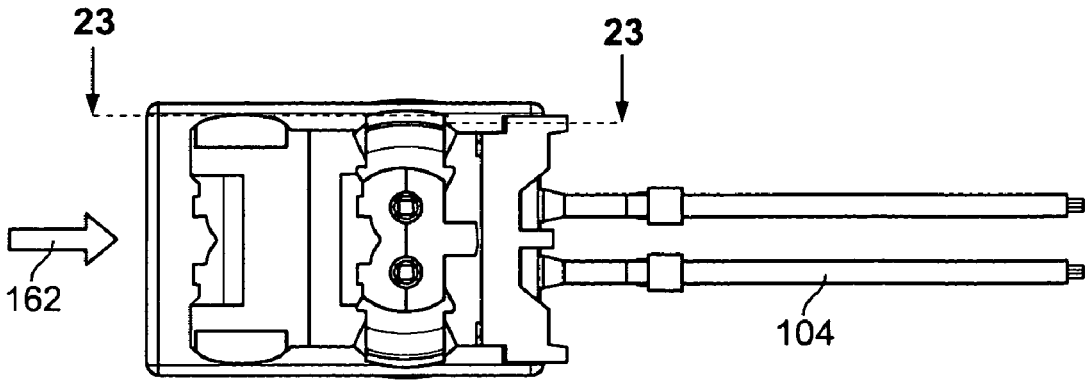
FIG. 22 is a bottom view of the connector face of the arrangement of FIG. 21.
Figure 23:
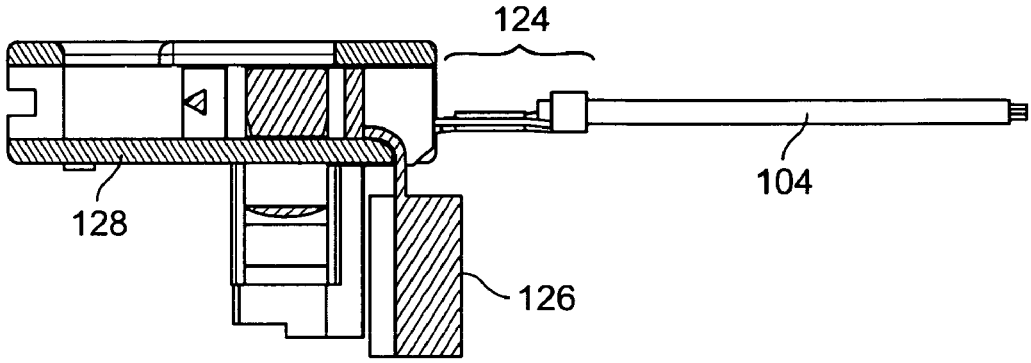
FIG. 23 is a sectional view taken along section line 23—23 of FIG. 22 immediately after production of the crimp connection.
Figure 24:
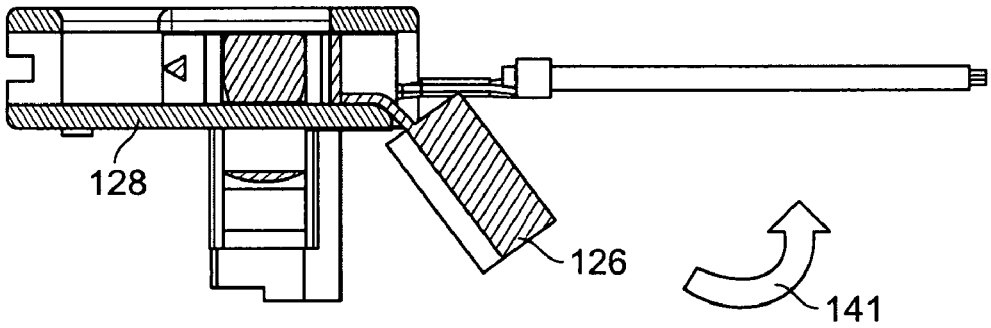
FIG. 24 is the section of FIG. 23 during displacement of the second lid into the final assembled position.

FIGS. 20 and 21 show the connector 100 immediately after the crimping process. In order to allow unimpeded access to the terminal areas 124 of the contact elements 120 from all sides for the crimping process, the first lid part 126 is folded in direction 140. In this way, the crimp area is freely accessible and a wiring manufacturer can perform crimping in a wholly conventional manner. In particular, the tools do not have to adapt. It is possible to produce the two contacts either simultaneously or separately. To do this, the first lid part 126 has to be held in the folded-back position, as shown in FIG. 21, since the film hinge 152 exhibits a certain restoring force.

FIGS. 22 to 25 explain the method steps performed from connection of the electrical leads 104 until full assembly is achieved. According to the invention, the second lid part 128 is here used as an actuating and securing element for the first lid part 126. Force acting on the second lid part 128 displaces it in direction 162, as is clear from the sectional illustrations, the first lid part 126 thereby being pivoted in direction 141 back out of its bent position until the terminal area 124 is covered on one side. At the same time, the second lid part 128 also covers the terminal area 124 on the opposing side. Through latching together with the second latching receptacle 160 by the latching arm 110, the second lid part 128 is held precisely in this position. A safeguard against unintentional displacement of the second lid part 128 even in the event of the latching arms 110 being actuated is provided by the latching elements 164, which cooperate with latch openings 166 to secure the second lid part 128 to the housing 116. As is clear from sectional illustration 26—26 of FIG. 26, the first lid part 126 is held secure via appropriate guide projections on the second lid part 128.

Figure 25:
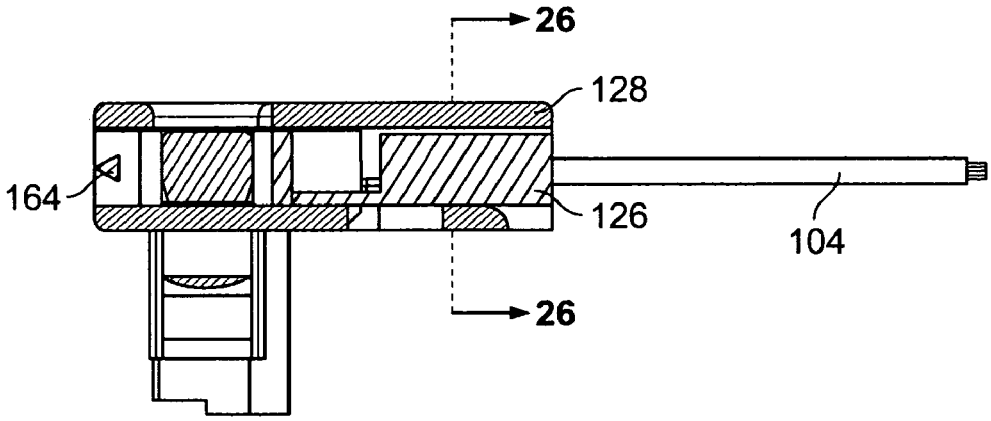
FIG. 25 is the section of FIGS. 23 and 24 in the final assembled state.
Figure 26:
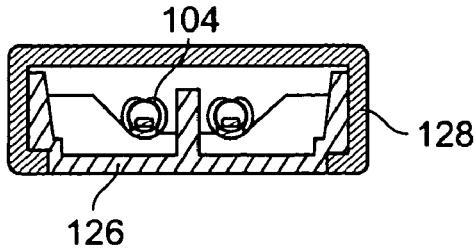
FIG. 26 is a sectional view taken along section line 26—26 of FIG. 25.

In the position shown in FIG. 25, showing final fitting to a cable harness, the contact elements 120 are thus locked in place and the terminal area 124 is fully protected. In addition to easy, efficient fitting, particularly reliable electrical contactability may also be ensured. The electrical connector 100 according to the invention may be used without further modification by any desired wiring manufacturer and fitting to the electrical leads 104 is greatly simplified.

A particularly reliable electrical connection may thus be achieved, as well as simplicity of assembly. With the solution according to the invention, no additional components are required for the assembly process after connection of the contact elements to the electrical leads. The preliminary latched position of the individual components intended for transportation of the contact elements not as yet connected additionally offers optimum protection of the sensitive contact and crimp areas at such a time. Furthermore, the solution according to the invention offers the advantage that the connector exhibits a particularly small structural size.

What is claimed is:

1. An electrical connector for contacting at least one electrical lead and for connection with a complementary connector, the connector comprising:

at least one contact element, having a contact area, which cooperates with an associated complementary contact element of the complementary connector to produce an electrical connection and, a terminal area, which may be connected with the at least one electrical lead, and a housing, in which the contact element is at least partially accommodated; on which there is arranged a terminal cover for covering the terminal area, the cover comprises a first lid part and a second lid part, which are so constructed that they may both be moved to expose the terminal area during fitting of the electrical lead; and on which there is arranged a latching projection for cooperating with a latching recess of a complementary connector, the latching projection being molded on to a resilient latching arm which cooperates with the second lid part to fix the second lid part in a preliminary latched position.

2. An electrical connector according to claim 1, wherein the terminal area of the contact element is a crimp zone.

3. An electrical connector according to claim 1, wherein the second lid part may be latched together with the housing in the final assembled position.

4. An electrical connector according to claim 1, wherein the first lid part is mounted pivotally.

5. An electrical connector according to claim 4, wherein the first lid part is connected to the housing via at least one film hinge.

6. An electrical connector according to claim 4, wherein the second lid part is displaceable between the preliminary latched position, in which the terminal area is accessible, and a final assembled position, in which the terminal area is covered.

7. An electrical connector according to claim 6, wherein the second lid part is so constructed such that it moves the first lid part on displacement into the final assembled position.

8. An electrical connector according to claim 1, wherein the contact element comprises a bending zone between the terminal area and the contact area, in which bending zone the contact element is bent when finally fitted.

9. An electrical connector according to claim 8, wherein the housing comprises a bending edge for bending of the contact element during fitting.

10. An electrical connector according to claim 1, wherein a ferrite core is arranged on the at least one contact element to attenuate radio frequency interference.

11. An electrical connector according to claim 10, wherein the at least one contact element further comprises at least one fixing element for fixing the contact element in the ferrite core.

12. An electrical connector according to claim 11, wherein at least two contact elements are arranged in a multi-path ferrite core of one-piece construction.

13. A method of assembling an electrical connector for contacting at least one electrical lead and for connection with a complementary connector, wherein the method comprises the following steps:

positioning in a housing at least one contact element, which cooperates, in a contact area, with an associated second contact element of the complementary connector to produce an electrical connection and which receives, in a terminal area, at least one electrical lead, in a housing, such that the first contact element is partially located in the housing;

moving a first lid part of a terminal cover for covering the terminal area into an open position on the housing, such that the terminal area is freely accessible for connection of the at least one electrical lead;

connecting the at least one electrical lead to the terminal area of the contact element;

displacing a second lid part of the terminal cover on the housing, such that it moves the first lid part into a final assembled position and at the same time the second lid part covers part of the terminal area.

14. A method according to claim 13, wherein the first lid part is pivoted into the open position about an axis perpendicular to the longitudinal axis of the lead.

15. A method according to claim 14, wherein the step of fitting the at least one contact element comprises:

introducing the contact area into a contact receptacle of the housing;

bending the contact element around a bending edge on the contact receptacle, until the longitudinal axis of the contact area forms an angle other than 0° with the longitudinal axis of the terminal area.

16. A method according to claim 15, wherein the angle amounts to around 90°.

17. A method according to claim 15, wherein the step of connecting the at least one electrical lead with the terminal area of the contact element includes a crimping process.

18. A method according to any one of claim 15, further comprising the step of:

fitting a ferrite core on the at least one contact element to attenuate radio frequency interference.

19. A method according to claim 18, wherein the at least one contact element is fixed in the ferrite core by a fixing element.

20. A method according to claim 18, wherein at least two contact elements are fitted in a multi-path ferrite core of one-piece construction.

21. An electrical connector for contacting at least one electrical lead and for connection with a complementary connector, the connector comprising:

at least one contact element, which cooperates, in a contact area, with an associated complementary contact element of the complementary connector to produce an electrical connection and which receives, in a terminal area, at least one electrical lead, the contact element having a bending zone between the terminal area and the contact area, in which bending zone the contact element is bent;

a housing, in which the at least one contact element is at least partially accommodated, the housing having at least one bending edge for bending the at least one contact element during assembly; and a terminal cover arranged on the housing to cover the terminal area, the cover comprises a first lid part and a second lid part, which are so constructed that they may both be moved to expose the terminal area during insertion of the electrical lead.

22. An electrical connector according to claim 21, wherein the terminal area of the at least one first contact element takes the form of a crimp zone.

23. An electrical connector according to claim 21, wherein the second lid part may be latched together with the housing in the final assembled position.

24. An electrical connector according to claim 21, wherein a ferrite core is arranged on the contact element for attenuating radio frequency interference.

25. An electrical connector according to claim 24, wherein the at least one contact element comprises at least one fixing element for fixing the contact element in the ferrite core.

26. An electrical connector according to claim 24, wherein at least two contact elements are arranged in a multi-path ferrite core of one-piece construction.

27. An electrical connector according to claim 21, wherein the first lid part is mounted pivotally.

28. An electrical connector according to claim 27, wherein the first lid part is connected to the housing via at least one film hinge.

29. An electrical connector according to claim 21, wherein the second lid part is displaceable between a preliminary latched position, in which the terminal area is accessible, and a final assembled position, in which the terminal area is covered.

30. An electrical connector according to claim 29, wherein the second lid part is so constructed that it moves the first lid part on displacement into the final assembled position.

31. An electrical connector according to claim 21, wherein at least one latching projection is molded onto the connector, the latching projection cooperates with a corresponding latching recess in the complementary connector for mechanically fixing the two connectors to each other.

32. An electrical connector according to claim 31, wherein the latching projection is molded onto a resilient latching arm.

33. An electrical connector according to claim 32, wherein the latching arm cooperates with the second lid part to fix the second lid part in the preliminary latched position.

34. A method of assembling an electrical connector for contacting at least one electrical lead and for connection with a complementary connector, wherein the method comprises the following steps:

moving a first lid part of a terminal cover for covering the terminal area into an open position on a housing, such that a terminal area is freely accessible for connection of at least one electrical lead;

fitting at least one contact element, which cooperates, in a contact area, with an associated second contact element of the complementary connector to produce the electrical connection and which may be connected, in the terminal area, with the at least one electrical lead, in the housing, such that the first contact element is accommodated at least partially in a receptacle in the housing;

bending the contact element around a bending edge on the receptacle, until the longitudinal axis of the contact area forms an angle other than 0° with the longitudinal axis of the terminal area;

connecting the at least one electrical lead to the terminal area of the contact element; and;

displacing a second lid part of the terminal cover on the housing, such that it moves the first lid part into a final assembled position and at the same time the second lid part covers part of the terminal area.

35. A method according to claim 34, wherein the angle amounts to around 90°.

36. A method according to claim 34, wherein the step of connecting the at least one electrical lead with the terminal area of the contact element includes a crimping process.

37. A method according to claim 34, wherein the first lid part is pivoted into the open position about an axis perpendicular to the longitudinal axis of the lead.

38. A method according claim 34, further comprising the step of:

fitting a ferrite core on the at least one contact element to attenuate radio frequency interference.

39. A method according to claim 38, wherein the at least one contact element is fixed in the ferrite core by means of a fixing element.

40. A method according to claim 38, wherein at least two contact elements are fitted in a multi-path ferrite core of one-piece construction.

* * * * *